US006869173B2

(12) United States Patent
Bybee et al.

(10) Patent No.: US 6,869,173 B2
(45) Date of Patent: Mar. 22, 2005

(54) DIAPHRAGM PUMP FOR A FLUID SUPPLY

(75) Inventors: Cary R. Bybee, Lebanon, OR (US); Paul L. Nash, Monmouth, OR (US); Rebecca M. Seitz, Dayton, OH (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 12 days.

(21) Appl. No.: 10/384,313

(22) Filed: Mar. 7, 2003

(65) Prior Publication Data

US 2004/0174416 A1 Sep. 9, 2004

(51) Int. Cl.[7] ..... B41J 2/175
(52) U.S. Cl. ..... 347/85; 347/86
(58) Field of Search ..... 347/7, 85, 86, 347/87, 104; 523/211

(56) References Cited

U.S. PATENT DOCUMENTS 5,734,401 A 3/1998 Clark et al.
5,834,536 A * 11/1998 Scholl ..... 523/211
5,854,646 A 12/1998 Barinaga et al.
5,856,839 A 1/1999 Aukstikalnis et al.
6,312,116 B2 11/2001 Underwood et al.
6,322,207 B1 11/2001 Hall et al.
6,350,024 B2 2/2002 Haines
6,485,137 B2 11/2002 Karlinski et al.

* cited by examiner

*Primary Examiner*—Anh T. N. Vo
(74) *Attorney, Agent, or Firm*—Donald J. Coulman

(57) ABSTRACT

A fluid supply providing fluid to a fluid ejection cartridge, includes a chassis that partially defines a variable volume chamber. The chassis has a sealing surface disposed proximate an opening in the chamber. In addition, the fluid supply includes a compressive layer formed from an ethylene propylene-diene copolymer and an isobutylene isoprene copolymer. Further the fluid supply includes a fastening device disposed on the chassis holding the compressive layer to the sealing surface forming a fluidic seal of a diaphragm pump.

30 Claims, 6 Drawing Sheets

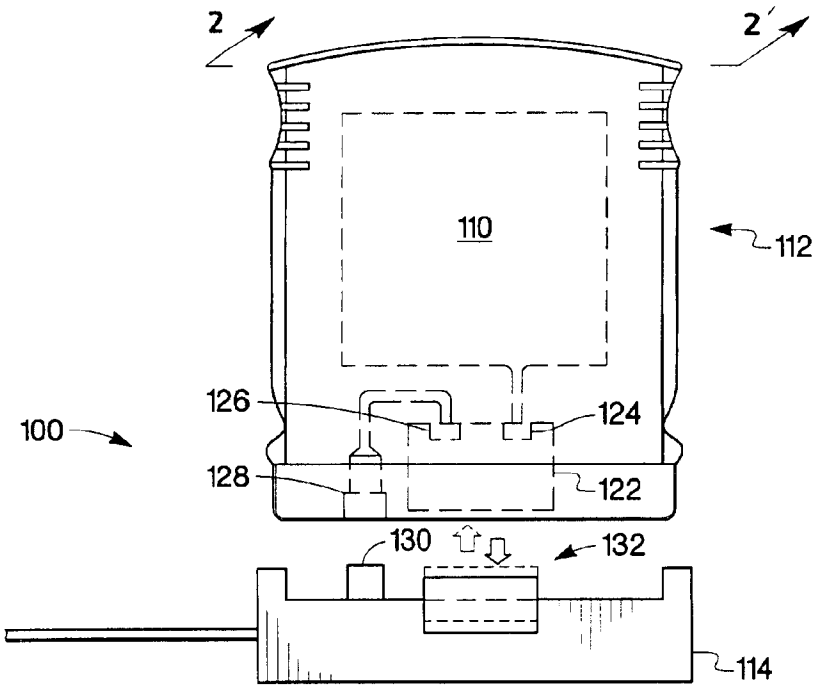
Fig. 1a
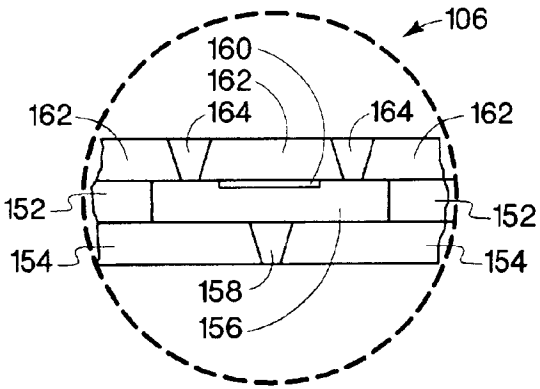
Fig. 1b
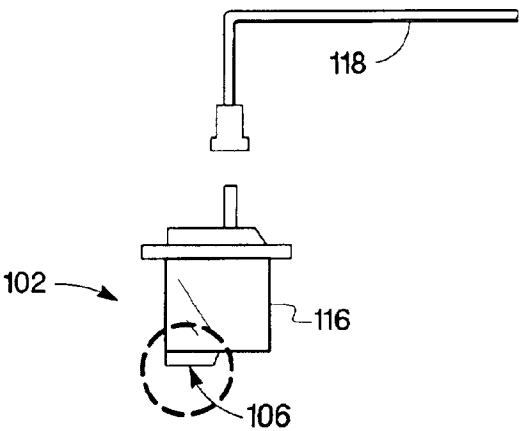

DIAPHRAGM PUMP FOR A FLUID SUPPLY

BACKGROUND

Description of the Art

Over the past decade, substantial developments have been made in the micro-manipulation of fluids in fields such as electronic printing technology using inkjet printers. As the volume of fluid manipulated or ejected decreases, the susceptibility to air or gas bubbles forming in the firing chamber or other fluid channels may increase. Fluid ejection cartridges and fluid supplies provide a good example of the problems facing the practitioner in preventing the formation of gas bubbles in microfluidic channels and chambers.

Currently there is a wide variety of highly efficient inkjet printing systems in use, which are capable of dispensing ink in a rapid and accurate manner. However, there is a demand by consumers for ever-increasing improvements in speed and image quality. In addition, there is also increasing demand by consumers for longer lasting fluid ejection cartridges. One way to increase the speed of printing is to move the print or fluid ejection cartridge faster across the print medium. However, if the fluid ejection cartridge includes both the fluid reservoir and the energy generating elements then longer lasting print cartridges typically would require larger ink reservoirs, with the corresponding increase in mass associated with the additional ink. This increase in mass requires more costly and complex mechanisms to move at even higher speeds to produce the increased printing speed. For color printers, typically, requiring a black ink cartridge and 3 color cartridges this increase in mass is further exacerbated by requiring four ink reservoirs.

Thus, in an effort to reduce the cost and size of ink jet printers and to reduce the cost per printed page, printers have been developed having small, moving printheads that are connected to large stationary ink supplies. This development is generally referred to as "off-axis" printing, and has allowed large ink supplies to be replaced as they are consumed without requiring the frequent replacement of the costly printheads containing the fluid ejectors and nozzle system. However, the typical "off-axis" system requires numerous flow restrictions between the ink supply and the printhead, such as additional orifices, long narrow conduits, and shut off valves. To overcome these flow restrictions and to also provide ink over a wide range of printing speeds, ink is now generally transported to the printhead at an elevated pressure. A pressure regulator is typically added to deliver the ink to the printhead at the optimum backpressure. Further, an "off-axis" printing system strives to maintain the backpressure of the ink within the printhead to within as small a range as possible. Typically changes in back pressure, of which air bubbles are only one variable, may greatly effect print density as well as print and image quality.

In addition, improvements in image quality have led to an increase in the complexity of ink formulations that increases the sensitivity of the ink to the ink supply and print cartridge materials that come in contact with the ink. Typically, these improvements in image quality have led to an increase in the organic content of inkjet inks that results in a more corrosive environment experienced by the materials utilized thus raising material compatibility issues.

In order to reduce both weight and cost many of the materials currently utilized are made from polymers such as plastics and elastomers. Many of these plastic materials, typically, utilize various additives, such as stabilizers, plasticizers, tackifiers, polymerization catalysts, and curing agents. These low molecular weight additives are typically added to improve various processes involved in the manufacture of the polymer and to reduce cost without severely impacting the material properties. Since these additives, typically, are low in molecular weight compared to the molecular weight of the polymer, they can leach out of the polymer by the ink, react with ink components, or both, more easily than the polymer itself causing such problems. In either case, the reaction between these low molecular weight additives and ink components can also lead to the formation of precipitates or gelatinous materials, which can further result in degraded print or image quality.

If these problems persist, the continued growth and advancements in inkjet printing and other micro-fluidic devices, seen over the past decade, will be reduced. Consumer demand for cheaper, smaller, more reliable, higher performance devices constantly puts pressure on improving and developing cheaper, and more reliable manufacturing materials and processes. The ability to optimize fluid ejection systems, will open up a wide variety of applications that are currently either impractical or are not cost effective.

BRIEF DESCRIPTION OF THE DRAWINGS

FIG. 1*a* is a schematic representation of a fluid supply having a diaphragm pump according to an embodiment of the present invention;

FIG. 1*b* is a cross-sectional view of a portion of a fluid ejector head according to an embodiment of the present invention;

DESCRIPTION OF THE PREFERRED EMBODIMENTS

Figure 2B:
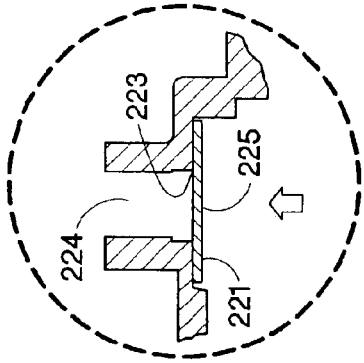
FIG. 2*b* is an expanded cross-sectional view of a disk valve shown in FIG. 2*a* according to an embodiment of the present invention.

Referring to FIG. 1*a*, an embodiment of fluid supply system 100 of the present invention is shown in a schematic view. In this embodiment, fluid supply system 100 includes diaphragm pump portion 122 that provides control of fluid flowing from fluid container 112 to fluid reservoir 116 disposed in fluid ejection cartridge 102. Fluid supply system 100 also includes supply station 114 for receiving fluid container 112. Supply station 114 is fluidically coupled to fluid ejection cartridge 102 by conduit 118.

Fluid container 112 includes a fluid supply reservoir 110 and inlet 124 for selectively allowing fluid to pass from fluid supply reservoir 110 to diaphragm pump portion 122. Fluid container 112 also includes fluid outlet 126 for selectively allowing fluid to pass from diaphragm pump portion 122 to container outlet 128. Supply station 114 includes station inlet 130 and pump actuator 132. With fluid container 112 properly positioned in supply station 114 container outlet 128 fluidically connects with station inlet 130. In addition, proper positioning of fluid container 112 in supply station 114 also allows pump actuator 132 to engage diaphragm pump portion 122. This engagement between pump actuator 132 and diaphragm pump portion 122 generates the mechanical motion to impart sufficient energy to the fluid to cause fluid from fluid supply reservoir 110 to flow to fluid ejection cartridge 102. Diaphragm pump portion 122 and actuator 132 ensure a substantially constant supply of fluid to fluid ejection cartridge 102.

A cross-sectional view of fluid ejector head 106 of fluid ejection cartridge 102 is shown in FIG. 1*b*. Fluid ejector head 106 includes substrate 162 that has fluid ejector actuator 160 formed thereon. Fluid ejector actuator 160, in this embodiment, is a thermal resistor; however, other fluid ejector actuators may also be utilized such as piezoelectric, flex-tensional, acoustic, and electrostatic. Chamber layer 152 forms fluidic chamber 156 around fluid ejector actuator 160, so that when fluid ejector actuator 160 is activated, fluid is ejected out of nozzle 158, which is generally located over fluid ejector actuator 160. Fluid channels 164 formed in substrate 162 provide a fluidic path for fluid in reservoir 116 to fill fluidic chamber 156. Nozzle layer 154 is formed over chamber layer 152 and includes nozzle 158 through which fluid is ejected.

It should be noted that the drawings are not true to scale. Further, various elements have not been drawn to scale. Certain dimensions have been exaggerated in relation to other dimensions in order to provide a clearer illustration and understanding of the present invention.

In addition, although some of the embodiments illustrated herein are shown in two dimensional views with various regions having depth and width, it should be clearly understood that these regions are illustrations of only a portion of a device that is actually a three dimensional structure. Accordingly, these regions will have three dimensions, including length, width, and depth, when fabricated on an actual device. Moreover, while the present invention is illustrated by various embodiments, it is not intended that these illustrations be a limitation on the scope or applicability of the present invention. Further it is not intended that the embodiments of the present invention be limited to the physical structures illustrated. These structures are included to demonstrate the utility and application of the present invention.

Referring to FIG. 2 a cross-sectional view of fluid container 112 engaged with supply station 114 is shown. Fluid container 112 includes fluid supply reservoir 210 that is in fluid communication with diaphragm pump portion 222 via inlet 224. In this embodiment, inlet 224 includes disk valve 225 that allows fluid to pass from supply reservoir 210 to diaphragm pump portion 222 and hinders fluid passing from diaphragm pump portion 222 to supply reservoir 210. Diaphragm pump portion 222 expels fluid through fluid outlet 226. Fluid expelled from diaphragm pump portion 222 is then provided to the fluid ejection cartridge via the fluid interconnection formed between container outlet 228 and station inlet 230.

Diaphragm pump portion 222, in this embodiment, includes chassis 234 and diaphragm 236 that define a portion of chamber 238 having a variable volume. Disposed within chamber 238 is a biasing element. In this embodiment, the biasing element is coiled spring 240, however, in alternate embodiments other biasing elements or spring structures, such as a leaf spring or cantilever spring may also be utilized. Coiled spring 240 biases pressure plate 242 against diaphragm 236 that in turn biases diaphragm 236 towards pump actuator 232. Pump actuator 232 engages diaphragm 236 and displaces diaphragm 236 toward chamber 238 compressing coiled spring 240. As diaphragm 236 is displaced toward chamber 238 the volume of chamber 238 is reduced. The reduction in volume of chamber 238 increases the pressure exerted on the fluid in chamber 238 causing the fluid to pass through fluid outlet 226 towards the fluid ejection cartridge. In addition, the increase in pressure causes disk valve 225 in inlet 224 to close preventing or substantially hindering fluid flow back into supply reservoir 210 as shown in FIG. 2*b* in an expanded cross-sectional view. As pump actuator 232 is moved away from diaphragm 236 coiled spring 240 expands displacing pressure plate 242 and diaphragm 236 away from chamber 238, increasing the volume of chamber 238, and thereby reducing the chamber pressure. The reduction in the chamber pressure allows fluid to flow from fluid supply reservoir 210 through inlet 224 passed disk or check valve 225 to chamber 238 as shown in FIG. 2*c* in an expanded cross-sectional view.

Figure 2C:
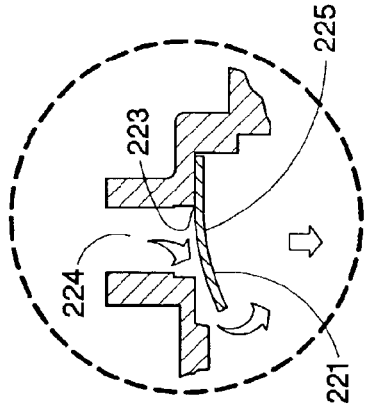
FIG. 2*c* is an expanded cross-sectional view of the disk valve shown in FIG. 2*b* according to an embodiment of the present invention.
Figure 2A:
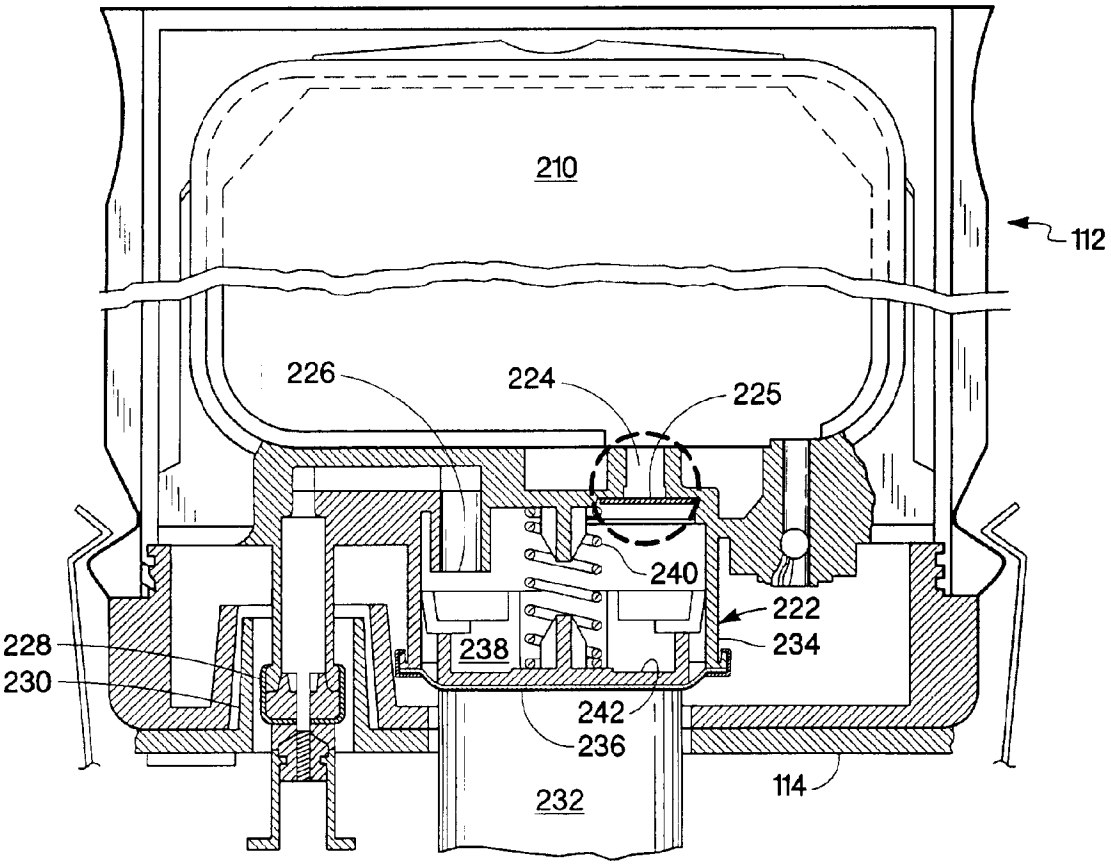
FIG. 2*a* is a cross-sectional view a fluid container engaged with a supply station according to an embodiment of the present invention.

Still referring to FIGS. 2*a*–2*c*, disk valve 225 includes a free end 221 and attached end 223. Disk valve 225 generally is of uniform thickness, flexible and resiliently deformable. Disk valve 225 may be formed from a compressible material similar to that utilized to form diaphragm 236. In this embodiment, disk valve 225 is formed from an ethylene propylene-diene copolymer, commonly referred to as EPDM rubber, and an isobutylene-isoprene copolymer. However, in alternate embodiments, disk valve 225 may be formed from any flexible resiliently deformable material compatible with the particular fluid being utilized. In this embodiment, attached end 223 is to one side of inlet 224, in alternate embodiments attached end 223 may be attached in various manners such as at a single point along the edge or at a point in the center of inlet 224 as just a couple of examples.

Figure 3:
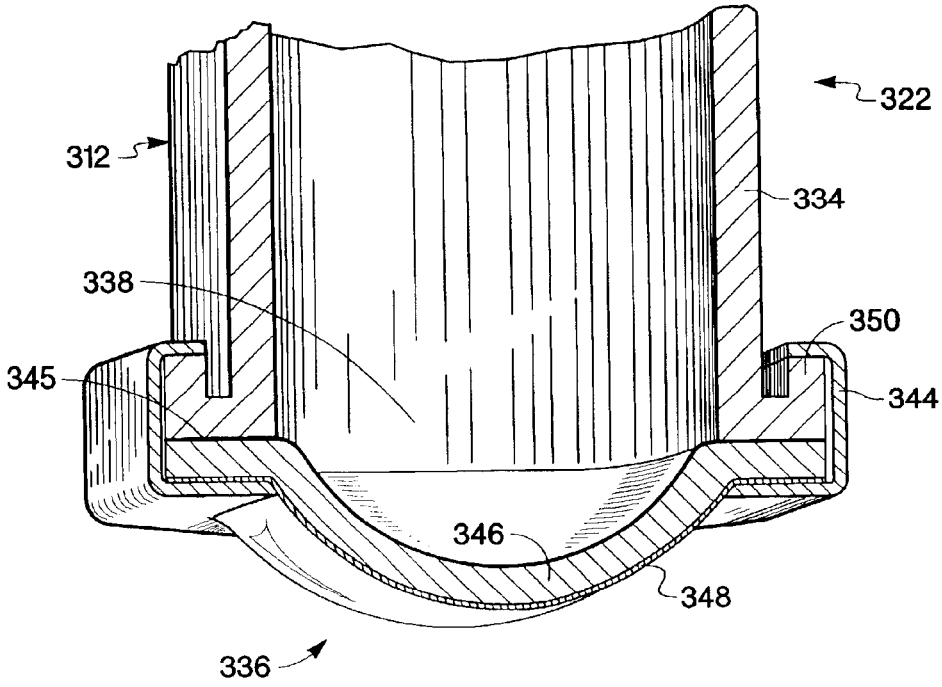
FIG. 3 is a simplified cross-sectional view of a diaphragm pump according to an embodiment of the present invention.

Referring to FIG. 3, an exemplary embodiment, of diaphragm pump portion 322 is shown in a simplified cross-sectional view. Diaphragm pump portion 322 includes chassis 334, diaphragm 336, and crimp cap 344 for attaching diaphragm 336 to chassis 334. In this embodiment, diaphragm 336 is formed from compressive layer 346 and outer layer 348. Compressive layer 346 is formed by compression molding a compressible material that can be held in compression by crimp cap 344. Compressive layer 346 forms a fluid seal with sealing surface 345 on flange 350. In alternate embodiments, compressive layer 346 may be formed by, for example, casting, injection molding, or other suitable methods. The thickness, shape, and size of diaphragm 336 will depend on various parameters, such as the particular fluid being utilized, the rate of ejection of fluid from the fluid ejection cartridge, withstanding pressure loads experienced during operation, withstanding pressure spikes if fluid container 312 is dropped, withstanding fatigue over the life of fluid container 312, and providing a fluid vapor barrier. For example, if the fluid includes water, compressive layer 346 provides a water vapor transmission rate sufficient to keep the loss of water to less than some desired level depending on, for example, the expected life of fluid container 312.

Still referring to FIG. 3, in this embodiment, outer layer 348 is in contact with air and provides an additional air barrier sufficient to keep ingress or permeation of air such as oxygen and nitrogen from chamber 338. Air permeating through diaphragm 336 may lead to air dissolving in the fluid being pumped and it may also lead to the formation of bubbles inside chamber 338 or both. Either air dissolved in the fluid or bubbles formed in chamber 338 may result in bubbles passing or forming in the fluid ejection cartridge. Such a formation of bubbles in the fluid ejection cartridge may reduce the fluid ejection cartridge reliability, or it may change the amount of fluid ejected, or both. In addition, in this embodiment, outer layer 348 may also have a low fluid vapor barrier rate or low permeability rate for the particular fluid being pumped. In this embodiment, outer layer 348 is formed from a high vapor or gas barrier polymeric film such as polyvinylidene chloride (PVDC). However, in alternate embodiments, other polymeric materials may also be utilized such as those having a low oxygen permeability, or having a low water vapor transmission rate, or both. The particular material chosen will depend on various parameters such as the particular fluid utilized, the permeation rates of the compressive layer and the expected lifetime of the fluid supply. Further, outer layer 348 may also have a high fatigue life to withstand operation over a large number of pumping cycles without a substantial increase in air or fluid permeability over the life of fluid container 312. In this embodiment, outer layer 348 should also be suited to mechanical fastening utilizing crimp cap 344. However, in alternate embodiments outer layer 348 may be optimized for other parameters depending on the particular alternative fastening method used.

In this embodiment, compressive layer 346 includes 50 parts per hundred parts of rubber (phr) of an ethylene propylene-diene copolymer, commonly referred to as EPDM rubber, 50 parts per hundred parts of rubber of an isobutylene-isoprene copolymer, commonly referred to as Butyl rubber, and 2.5 parts per hundred parts of rubber of a polyisoprene polymer. In alternate embodiments, compressive layer 346 may include an ethylene propylene-diene copolymer in the range from about 40 phr to about 60 phr, and isobutylene-isoprene copolymer in the range from about 40 phr to about 60 phr, and a polyisoprene polymer in the range from about 0.0 phr to about 5.0 phr. In this embodiment, compressive layer 346 further includes 45 parts per hundred parts of rubber of an N550 carbon black, 1 part per hundred parts of rubber of stearic acid, 1.5 parts per hundred parts of rubber of polyethylene glycol, and 7 parts per hundred parts of rubber of a commercial cross-linking agent including 40 weight percent di(2-tert-butylperoxyisopropyl) benzene. In alternate embodiments, compressive layer 346 may include a carbon black in the range from about 20 phr to about 70 phr, stearic acid in the range from about 0 phr to about 2 phr, polyethylene glycol in the range from about 0 phr to about 5.0 phr, and a commercial cross-linking agent including 40 weight percent di(2-tert-butylperoxyisopropyl) benzene in the range from about 2 phr to about 11 phr. In still other embodiments, compressive layer 346 may include an acrylic cross-linking co-agent in the range from about 0 phr, to about 3 phr. And in still other embodiments, other fillers and processing aids may also be utilized. For example, various clays, and silicas may be utilized as alternative fillers.

In this embodiment, compressive layer 346 has a tensile strength of 1300 pounds per square inch, an elongation of about 150 percent, and a 100 percent modulus of 780 pounds per square inch according to the American Society for Testing and Materials (ASTM) method D412 utilizing die C, pulled at 20 inches per minute. In alternate embodiments, compressive layer 346, may have a tensile strength in the range from about 1000 pounds per square inch to about 2000 pounds per square inch, an elongation from about 90 percent to about 190 percent, and a 100 percent modulus in the range from about 600 pounds per square inch to about 1400 pounds per square inch. In addition, in this embodiment, compressive layer 346 has a compression set of about 2.4 percent after 22 hours at 70° C. according to ASTM D395 method B, utilizing 25 percent deflection and plied samples; and a tear strength of 70 pounds force per inch according to ASTM method D624. In alternate embodiments, a compressive layer having a compression set in the range from about 0.5 percent to about 10 percent, and a tear strength in the range from about 45 pounds force per inch to about 125 pounds force per inch.

Figure 4:
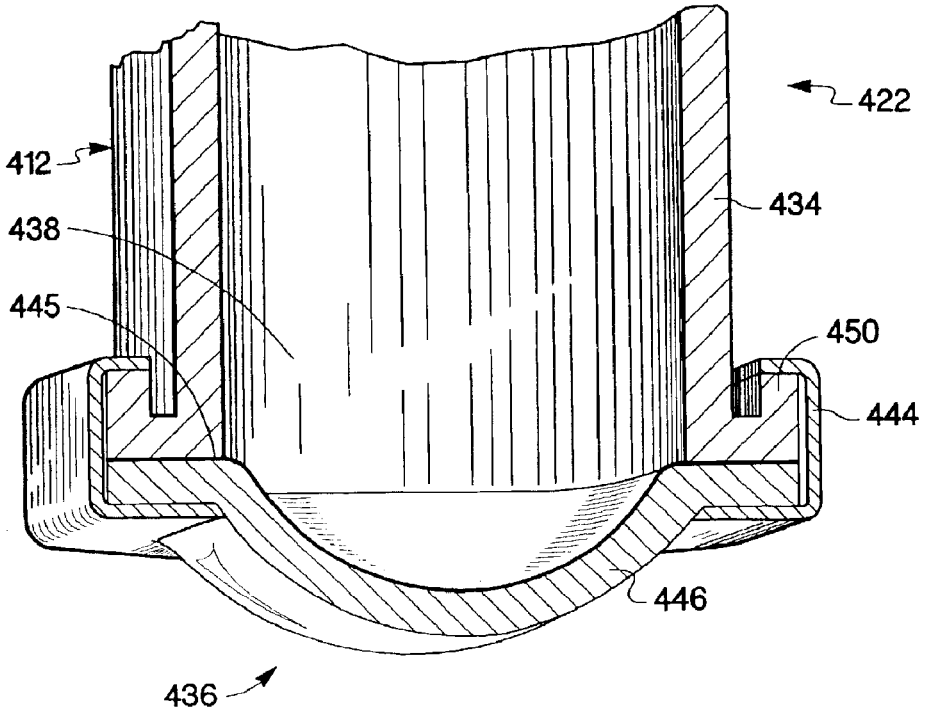
FIG. 4 is a simplified cross-sectional view of a diaphragm pump according to an alternate embodiment of the present invention.

Referring to FIG. 4, an alternate embodiment, of diaphragm pump portion 422 of the present invention is shown in a simplified cross-sectional view. Diaphragm pump portion 422 includes chassis 434, diaphragm 436, and crimp cap 444 for attaching diaphragm 436 to chassis 434. In this embodiment, diaphragm 436 is formed from compressive layer 446. Compressive layer 446 is formed by compression molding a compressible material such as, for example, the materials described above for the embodiment shown in FIG. 3. Compressive layer 446 may be held in compression by crimp cap 444 to form fluid seal 445 between diaphragm 436 and sealing surface 445 of flange 450. In this embodiment, compressive layer 446 provides both the fluid vapor barrier, as well as, the air vapor barrier preventing fluid in chamber 438 from evaporating and preventing air from permeating into chamber 438 forming bubbles. In an alternate embodiment, the fluid seal between diaphragm 436 and flange 450 may be formed utilizing a resilient material that snaps around the compressive layer and the flange thereby forming the fluid seal. In still other embodiments, adhesives, screws, rivets and other conventional fastening techniques may also be utilized to form the fluid seal.

Figure 5:
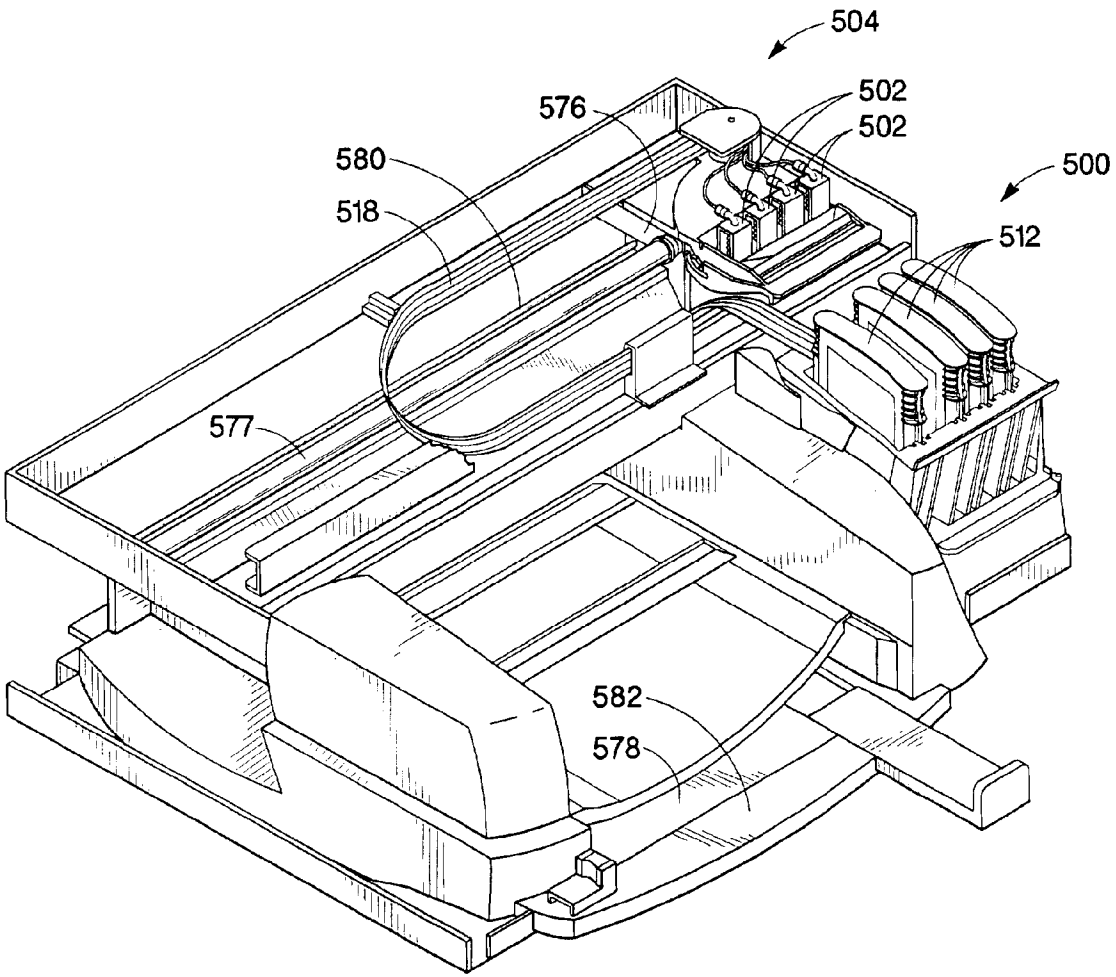
FIG. 5 is a perspective view of a fluid ejection system having a fluid supply according to an alternate embodiment of the present invention.

Referring to FIG. 5, a perspective view is shown of an exemplary embodiment of a fluid ejection system of the present invention. As shown fluid ejection system 504 includes fluid or ink supply 500, including one or more fluid or ink containers 512, commonly referred to as fluid or ink cartridges, that provide fluid to one or more fluid ejection cartridges 502. Fluid ejection cartridges 502 may be similar to fluid ejection cartridge 102, however, other fluid ejection cartridges may also be utilized. Fluid containers 512 are fluidically coupled to fluid ejection cartridges via flexible conduit 518. Fluid ejection cartridges 502 may be semi-permanently or removably mounted to carriage 576. In this embodiment, a platen or sheet advancer (not shown) to which print medium 578, such as paper, an ingestible sheet, or other appropriate medium for receiving fluid drops,.is transported by mechanisms that are known in the art. Carriage 576 is, typically, supported by slide bar 577 or similar mechanism within fluid ejection system 504; and physically propelled along slide bar 577 to allow carriage 576 to be translationally reciprocated or scanned back and forth across sheet 578. Fluid ejection system 504 may also employ coded strip 580, which may be optically detected by a photodetector (not shown) in carriage 576 for precise positioning of the carriage. Carriage 576 may be translated, in this embodiment, using a stepper motor (not shown), however, other drive mechanisms may also be utilized. In addition, the motor may be connected to carriage 576 by a drive belt, screw drive, or other suitable mechanism.

When a printing or a fluid ejection operation is initiated, print medium 578 in tray 582 is fed into a printing area (not shown) of fluid ejection system 504. Once print medium 578 is properly positioned, carriage 576 may traverse print medium 578 such that one or more fluid ejection cartridges 502 may eject ink onto print medium 578 in the proper position. Print medium 578 may then be moved incrementally, so that carriage 576 may again traverse print medium 578, allowing the one or more fluid ejection cartridges 502 to eject ink onto a new position on print medium 578. Typically, the drops are ejected to form predetermined dot matrix patterns, forming, for example, images or alphanumeric characters.

Rasterization of the data can occur in a host computer such as a personal computer or PC (not shown) prior to the rasterized data being sent, along with the system control commands, to the system, although other system configurations or system architectures for the rasterization of data are possible. This operation is under control of system driver software resident in the system's computer. The system interprets the commands and rasterized data to determine which drop ejectors to fire. Thus, when a swath of ink or fluid deposited onto print medium 578 has been completed, print medium 578 is moved an appropriate distance, in preparation for the next swath. This invention is also applicable to fluid dispensing systems employing alternative means of imparting relative motion between the fluid ejection cartridges and the print media, such as those that have fixed fluid ejection cartridges and move the print media in one or more directions, and those that have fixed print media and move the fluid ejection cartridges in one or more directions.

Figure 6:
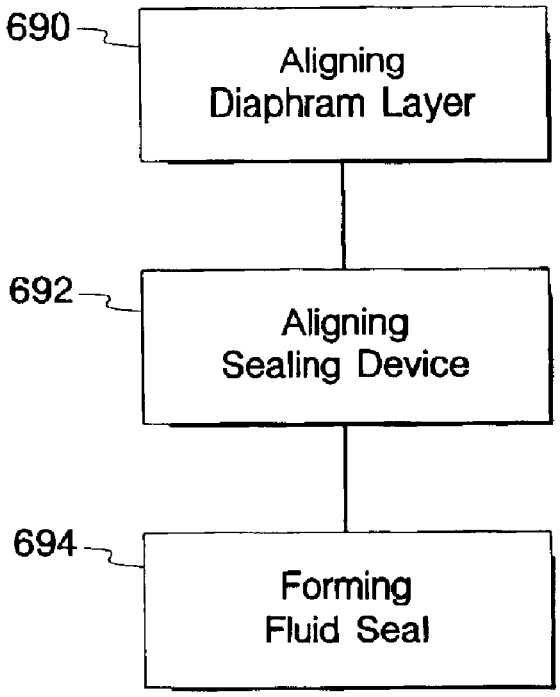
FIG. 6 is a flow chart of a method of making a diaphragm pump according to an embodiment of the present invention.

Referring to FIG. 6, a flow diagram of a method of manufacturing a diaphragm pump according to an embodiment of the present invention is shown. The process of aligning compressive layer 690 is used to align the compressive layer in the proper position with the opening in the chamber. Any of the conventional techniques for aligning parts may be utilized. For example, an electric or pneumatic motor or other actuator may move the chassis or fluid container in an X and Y direction to establish proper alignment with the compressive layer. In addition, typically a theta or rotational alignment about a Z-axis will also be provided. Either the chassis or fluid container or the compressive layer or both may be moved to ensure proper alignment. Further, sensors located on or near the chassis or fluid container, or an optical vision system or combination thereof will, typically, be utilized to provide feed back that the chassis or fluid container and the compressive layer are properly aligned. In those embodiments, utilizing an outer layer, the outer layer and compressive layer may be aligned together before alignment of the combined outer and compressive layers to the chassis is performed.

Aligning fastening device process 692 is utilized to position and align the fastening device with the compressive layer and the flange formed in the chassis or fluid container. Typically, this process may utilize similar techniques as that described above for aligning the compressive layer to the opening in the chamber.

Forming fluidic seal process 694 is utilized to generate a reliable fluidic seal between the compressive layer and the flange formed in the chassis or fluid container. In one embodiment, the fastening device is a crimp cap that is mechanically deformed around the flange to hold the compressive layer in compression against the sealing surface of the flange formed in the chassis. In this embodiment, conventional crimping techniques may be utilized to form a compression seal between the compressive layer and the chassis. In an alternate embodiment, the fastening device may be formed of a resilient material that snaps around the compressive layer and the flange thereby forming the fluid seal. In still other embodiments, adhesives, screws, rivets and other conventional fastening techniques may also be utilized.

What is claimed is:

1. A fluid supply providing fluid to a fluid ejection cartridge, comprising:

a chassis at least partially defining a variable volume chamber, said chassis having a sealing surface disposed proximate an opening in said chamber;

a compressive layer having an ethylene propylene-diene copolymer and an isobutylene isoprene copolymer, said compressive layer having a tear strength in the range from about 45 pounds force per inch to about 125 pounds force per inch; and a fastening device disposed on said chassis holding said compressive layer to said sealing surface forming a fluidic seal of a diaphragm pump.

2. The fluid supply in accordance with claim 1, wherein said compressive layer is disposed between said fastening device and said chassis.

3. The fluid supply in accordance with claim 1, wherein said fastening device engages a flange to compress said compressive layer against said sealing surface forming a compression seal between said compressive layer and said sealing surface of said chassis.

4. The fluid supply in accordance with claim 1, wherein said compressive layer further comprises a polyisoprene polymer.

5. The fluid supply in accordance with claim 4, wherein said polyisoprene polymer is less than about 5.0 parts per hundred parts of rubber (phr).

6. The fluid supply in accordance with claim 1, wherein said compressive layer further comprises an acrylic crosslinking co-agent.

7. The fluid supply in accordance with claim 6, wherein said compressive layer includes less than about 3 phr of said acrylic crosslinking co-agent.

8. The fluid supply in accordance with claim 1, wherein said compressive layer further comprises polyethylene glycol.

9. The fluid supply in accordance with claim 8, wherein said polyethylene glycol is less than about 5.0 phr.

10. The fluid supply in accordance with claim 8, wherein said polyethylene glycol is utilized as a de-tackifier.

11. The fluid supply in accordance with claim 1, wherein said compressive layer further comprises a crosslinking agent including di(2-tert-butylperoxyisopropyl) benzene.

12. The fluid supply in accordance with claim 11, wherein said crosslinking agent includes 40 weight percent of di(2-tert-butylperoxyisopropyl) benzene and said crosslinking agent is in the range from about 2 phr to about 11 phr.

13. The fluid supply in accordance with claim 1, wherein said compressive layer further comprises:

said ethylene propylene-diene copolymer in the range from 40 about phr to about 60 phr;

said isobutylene isoprene copolymer in the range from 40 about phr to about 60 phr;

polyethylene glycol less than about 5.0 phr; and a crosslinking agent including 40 weight percent of di(2-tert-butylperoxyisopropyl) benzene wherein said crosslinking agent is in the range from about 2 phr to about 11 phr.

14. The fluid supply in accordance with claim 1, wherein said compressive layer further comprises a carbon black.

15. The fluid supply in accordance with claim 14, wherein said carbon black is an N550 carbon black in the range from about 20 phr to about 70 phr.

16. The fluid supply in accordance with claim 1, wherein said compressive layer further comprises a stearic acid.

17. The fluid supply in accordance with claim 16, wherein said stearic acid is less than about 2 phr.

18. The fluid supply in accordance with claim 1, wherein said compressive layer is a vapor barrier layer.

19. The fluid supply in accordance with claim 1, wherein said tear strength is about 70 pounds force per inch.

20. The fluid supply in accordance with claim 1, wherein said compressive layer further comprises a compression set after 22 hours at 70° C. in the range from about 0.5 percent to about 10 percent.

21. The fluid supply in accordance with claim 20, wherein said compression is about 2.4 percent.

22. The fluid supply in accordance with claim 1, wherein said compressive layer further comprises a first and second layer with the first layer formed from an elastomeric material having an ethylene propylene copolymer and an isobutylene isoprene copolymer and the second layer includes a high oxygen barrier material.

23. The fluid supply in accordance with claim 1, wherein said fastening device is a crimp cap.

24. The fluid supply in accordance with claim 1, further comprising a disk valve disposed at an inlet of the fluid supply.

25. The fluid supply in accordance with claim 24, wherein said disk valve further comprises a compressible material including an ethylene propylene-diene copolymer and an isobutylene isoprene copolymer.

26. A fluid dispensing system comprising:

at least one fluid ejection cartridge having at least one fluid ejection energy generating element;

at least one fluid supply of claim 1;

at least one flexible fluid conduit fluidically coupling said at least one fluid supply to said at least one fluid ejection cartridge;

a drop-firing controller capable of activating said at least one fluid ejection energy generating element to eject at least one drop of a fluid onto a first portion of a print media; and a sheet advancer for advancing said print media, wherein said sheet advancer and said at least one fluid ejection cartridge are capable of dispensing fluid on a first portion of said print media.

27. The fluid dispensing system of claim 26, wherein said sheet advancer and said drop-firing controller are capable of dispensing said fluid in a two dimensional array on said first portion and on a second portion of said sheet.

28. A fluid supply providing fluid to a fluid ejection cartridge, comprising:

means for defining a chamber having an opening;

a compressive layer having an ethylene propylene-diene copolymer and an isobutylene isoprene copolymer, said compressive layer having a tear strength in the range from about 45 pounds force per inch to about 125 pounds force per inch; and means for fastening said compressive layer over said opening, whereby a diaphragm pump is formed.

29. A method of making a fluid supply diaphragm pump, comprising:

positioning a compressive layer formed from an ethylene propylene-diene copolymer and an isobutylene isoprene copolymer over a chassis having a variable volume chamber, said chassis having a sealing surface disposed proximate an opening in said chamber, said compressive layer having a tear strength in the range from about 45 pounds force per inch to about 125 pounds force per inch;

positioning a fastening device over said compressive layer; and fastening said fastening device forming a fluid seal between said compressive layer and said sealing surface of said chassis.

30. The method in accordance with claim 29, wherein positioning said fastening device further comprises positioning a crimp cap over said compressive layer and wherein fastening said fastening device further comprises crimping said crimp cap to compress said compressive layer against said sealing surface, holding said compressive layer securely to said chassis.

* * * * *